United States Patent [19]

Chilton

[11] 4,142,752

[45] Mar. 6, 1979

[54] BURGLAR ENTRY STOP DEVICE

[76] Inventor: James O. Chilton, 590 Flora St., Laguna Beach, Calif. 92652

[21] Appl. No.: 879,332

[22] Filed: Feb. 21, 1978

[51] Int. Cl.[2] ..... E05C 17/54

[52] U.S. Cl. ..... 292/343; 292/DIG. 15

[58] Field of Search ..... 292/343, 342, DIG. 15, 292/DIG. 19

[56] References Cited

U.S. PATENT DOCUMENTS

| | | | |
|---|---|---|---|
| 550,264 | 11/1895 | Flesch | 292/343 |
| 1,545,532 | 7/1925 | Stubbs | 292/343 |
| 1,845,829 | 2/1932 | Carnal | 292/343 |
| 1,939,402 | 12/1933 | Moser | 292/343 |
| 2,376,117 | 5/1945 | Bright et al. | 292/343 |
| 2,647,782 | 8/1953 | Fisk | 292/343 X |
| 3,124,382 | 3/1964 | Strother | 292/343 |
| 3,143,369 | 8/1964 | Adams | 292/343 X |

FOREIGN PATENT DOCUMENTS

| | | | |
|---|---|---|---|
| 278392 | 10/1930 | Italy | 292/343 |
| 259809 | 10/1926 | United Kingdom | 292/343 |

*Primary Examiner*—Roy D. Frazier
*Assistant Examiner*—William E. Lyddane
*Attorney, Agent, or Firm*—Knobbe, Martens, Olson, Hubbard & Bear

[57] ABSTRACT

A burglar entry stop device including a stop component tapered down at a front end and an upright handle to permit convenient placement of the front end of the stop component under the bottom edge of a door and provide additional leverage to prevent a door from being forced open completely from the outside.

13 Claims, 3 Drawing Figures

FIG. 1.
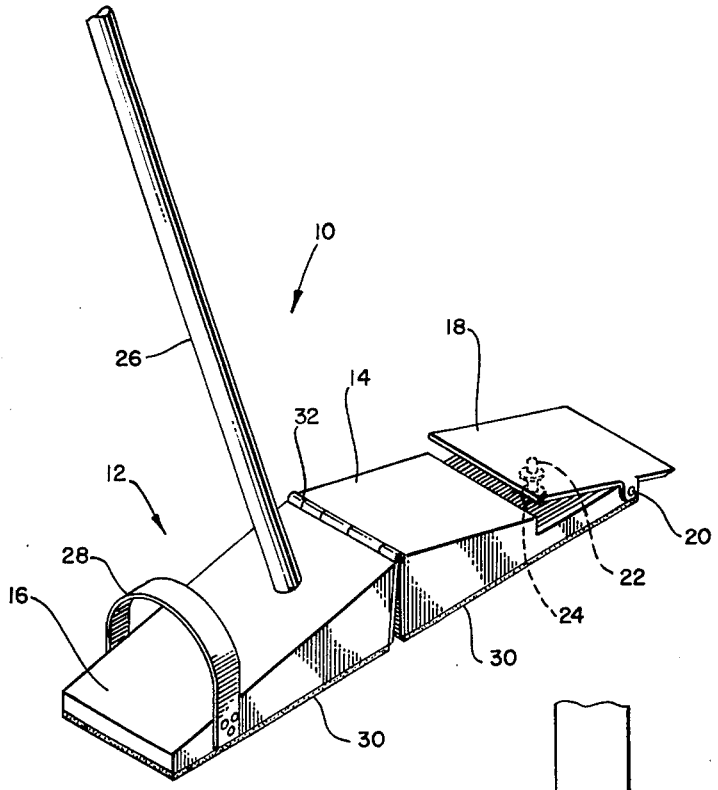
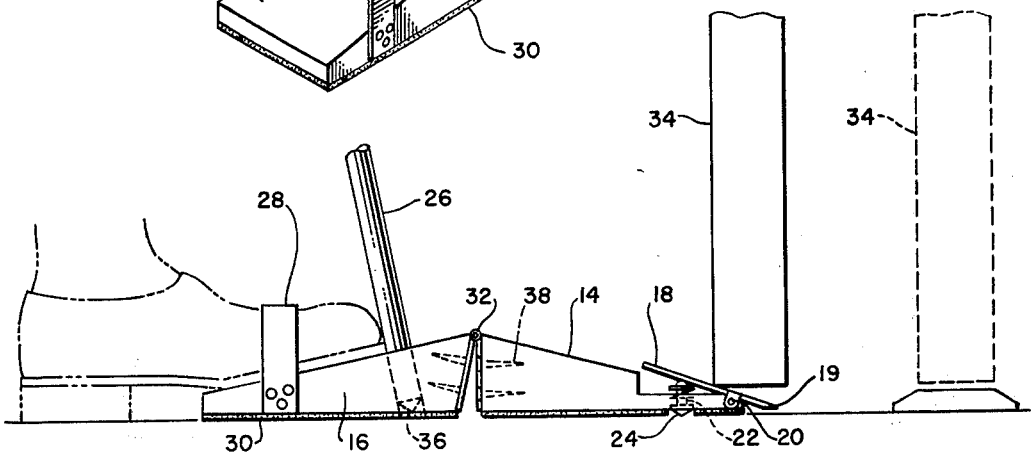
FIG. 2.
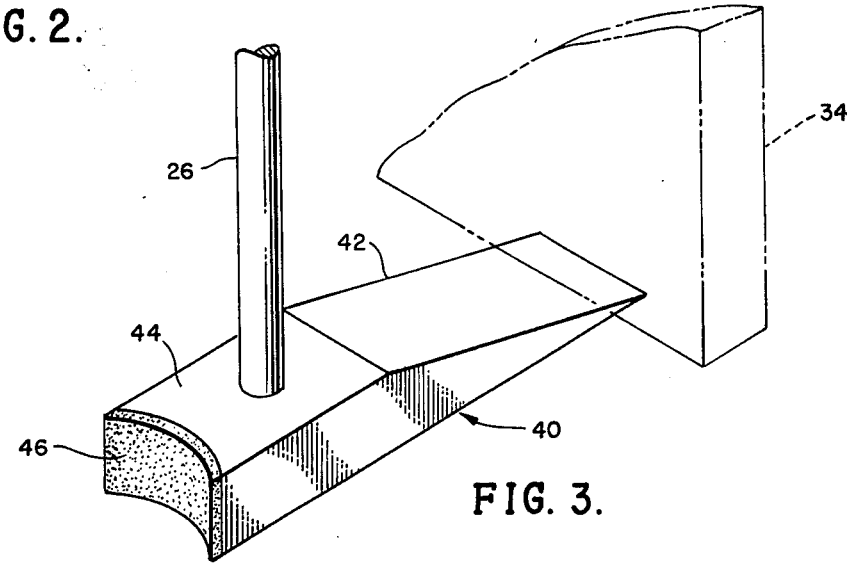
FIG. 3.

BURGLAR ENTRY STOP DEVICE

BACKGROUND OF THE INVENTION

The field of the invention relates generally to devices for preventing unwanted entry through a door. More specifically, it relates to wedged devices such as door stops, which are placed beneath the bottom edge of a door to prevent the door from opening completely.

It is known in the prior art to use wedged devices to prevent doors from opening or closing. However, these devices have not been designed for use by the elderly, sick or infirm.

First, most such devices lack mobility, being constructed to be placed permanently on the floor wedged under the door. Moving these wedges requires the user to stoop or kick the device with his foot, neither of which is a satisfactory operation for the infirm.

Secondly, these devices have lacked the resistance to prevent unwanted entry by an intruder. Most prior art devices were designed to hold the weight of a door, but not to withstand the additional force supplied by an intruder.

SUMMARY OF THE INVENTION

An object of the invention is to provide a device for preventing unwanted entry which can be easily operated by the elderly, sick or infirm.

A further object of the invention is to construct a device which possesses the qualities of mobility and resistance when used by the elderly, sick or infirm.

A further object is to design the device so that it may be constructed easily and economically.

The claimed device contains two basic elements: a stop component and a handle. In one embodiment, the stop component is tapered down at a front end which is wedged under a door when in use. An upright handle extends downward into the rear end of the stop component which provides easy positioning of the front, tapered end between the door and the floor and also provides leverage to oppose any force an intruder may apply to the door in attempting to open it.

BRIEF DESCRIPTION OF THE DRAWINGS

A detailed description of the invention will be made with reference to the accompanying drawings wherein:

FIG. 1 is a perspective view of the claimed invention;

FIG. 2 is a right side elevational view depicting the device in use;

FIG. 3 is a perspective view of an alternative embodiment of the device.

DESCRIPTION OF THE PREFERRED EMBODIMENTS

FIG. 1 depicts the burglar entry stop 10. The stop component 12 comprises a front end 14 and a rear end 16 both of which are tapered down to form an apex.

In this embodiment, a steel plate 18 is attached to the front end 14 by a pivotal pin 20. Extending downward through the front end 14 is an appendage such as a spring biased steel pin 22 whose top end is contiguous with the underside of the steel plate 18 and which has a pointed head 24 on the lower or opposite end. Thus the forward edge 19 of plate 18 is maintained in downward position to prevent interference with the bottom edge of the door 34. Extending into the rear end 16 is an upright handle 26. In one embodiment, the handle extends down completely through the rear end 16. A foot strap 28 is securely attached to rear end 16. Covering the bottom of the stop component 12 is a gripping adherent surface 30. Also in this embodiment, the rear end 16 and front end 14 are attached by hinge 32 at the apex.

FIG. 2 illustrates the device in operation. A door 34 is shown in a closed position and in an opening position. When a user opens the door a crack to ascertain the identity of a visitor, the front end 14 is slipped beneath the door as shown with the pushing of the user's foot in the strap 28 and/or the grasping of the handle 26. Wedging the front end 14 beneath the door applies a downward force to the steel plate 18 which in turn drives the appendage or pin 22 down into the floor. This concentrates substantially all of the downward force on one point, i.e., the pin head 24, so that the resistance provided by the device against the force of the opening door is greatly increased.

In this embodiment the handle 26 extends downward completely through the rear end 16 ending in a tapered point 36. When the user applies a downward force on the handle 26, this forces the tapered point 36 into the floor. This operation concentrates some of the user's downward force into a single point and thereby greatly increases the resistance of the device to the force of the door. Rear end 16 and front end 14 are shown connected by a hinge 32. The hinge is attached to the device by screws 38. The hinge allows greater mobility of the device upon uneven floor surfaces and allows the user to lift the rear end 16 when positioning the front end 14 under the door and when driving the handle point 36 into the floor.

FIG. 3 is an alternative embodiment of the device comprising a solid stop component 40 with a front end 42 tapered for wedging beneath the door 34. The upright handle 26 is permanently fitted into the rectangular shaped rear end 44. A padded, concave notch 46 is provided at the rear end 44 of stop component 40 enabling the toe of the user's shoe to position the stop device beneath the door and to apply force against an opening door.

The stop component and the handle may be manufactured from any resistant material, preferably wood. The dimensions of the device should be fashioned so that the device can be made from wood scraps which are readily available and unwanted in manufacturing industries using wood such as the furniture industry. This will allow the device to be manufactured simply and economically and these savings can then be passed on to the consumer.

The gripping material 30 may be rubber or sandpaper or the like or simply a serrated wood pattern. In addition, the rubber may be serrated to increase its gripping qualities.

It is the intent that the claims which follow be read in light of and consistently with the scope and nature of the inventive concept and the manner in which that concept is utilized and not upon the merely exemplary embodiment by which the invention is depicted and described hereinbefore.

It will be apparent to those skilled in the art that various changes in the size, shape, number and arrangement of parts described hereinbefore may be made without departing from the spirit of this invention.

I claim:

1. A device for preventing entry through a door, comprising:

barrier means for stopping the door;

leverage means connected to said barrier means for positioning said barrier means beneath the door and for applying additional force against the door;

a plate pivotally mounted adjacent one end of said barrier means; and plunger means movably mounted beneath said plate to said barrier means, said plunger means exerting pressure against the floor as said door exerts pressure against said plate.

2. The device of claim 1 wherein said leverage means comprises a handle extending completely through the rear end of said barrier means.

3. The device of claim 2 wherein an underside of said barrier means including the downward end of said handle is covered with a gripping material.

4. The device of claim 3 wherein said gripping material is rubber.

5. The device of claim 4 further comprising:

means for holding a user's foot in place, said holding means connected onto the rear end of said barrier means.

6. The device of claim 5 wherein the downward end of said handle is pointed.

7. A device for preventing entry through a door, comprising:

a stop component tapered down at a front end;

a rigid plate pivotally mounted to said front end of said stop component; and an appendage movably mounted to said stop component and extending therethrough, said appendage cooperating with said rigid plate so that as the door contacts said rigid plate said appendage will exert pressure against the floor.

8. A device for preventing entry through a door, comprising:

a stop component tapered down at both a front end and a rear end forming an apex between said ends;

an upright handle having a downward end extending down into the rear end of said stop component;

a metal plate pivotally mounted to a tapered side of the front end of said stop component; and an appendage movably mounted to said stop component whose top is contiguous with said metal plate and extends downward through the front end of said stop component so that as the door exerts pressure against said metal plate, the appendage will exert a downward pressure against a floor.

9. The device of claim 8 wherein the handle extends completely through the rear end of said stop component.

10. The device of claim 9 wherein an underside of said stop component including the downward end of said handle is covered with a gripping material.

11. The device of claim 10 wherein said gripping material is rubber.

12. The device of claim 11 further comprising:

means for holding a user's foot in place, said holding means connected onto the rear end of said stop component.

13. The device of claim 12 wherein the front end of said stop component is hinged at the apex to the rear end of said stop component.

* * * * *